US005500984A

United States Patent [19]

Lee

[11] Patent Number: 5,500,984

[45] Date of Patent: Mar. 26, 1996

[54] REFRIGERATOR DOOR OPENING/CLOSING APPARATUS

[75] Inventor: Hyun Sub Lee, Anyang, Rep. of Korea

[73] Assignee: Samsung Electronics Co., Ltd., Suwon, Rep. of Korea

[21] Appl. No.: 343,905

[22] Filed: Nov. 17, 1994

[30] Foreign Application Priority Data

Nov. 30, 1993 [KR] Rep. of Korea ..... 1993-25787 U

[51] Int. Cl.[6] ..... E05F 1/02

[52] U.S. Cl. ..... 16/309; 16/312; 49/239

[58] Field of Search ..... 16/312, 313, 317, 16/316, 315, 314; 49/237, 238, 239, 236

[56] References Cited

U.S. PATENT DOCUMENTS

| | | | |
|---|---|---|---|
| 3,378,881 | 4/1968 | Hentzi et al. | 16/312 |
| 3,398,487 | 8/1968 | Matyas | 16/312 |
| 3,546,736 | 12/1970 | Booth | 16/312 |
| 3,628,845 | 12/1971 | Grimm | 16/312 |
| 4,090,274 | 5/1978 | Bourgeois | 16/317 |

FOREIGN PATENT DOCUMENTS

| | | |
|---|---|---|
| 60-12179 | 1/1985 | Japan . |

*Primary Examiner*—P. Austin Bradley
*Assistant Examiner*—Chuck Y. Mah
*Attorney, Agent, or Firm*—Burns, Doane, Swecker & Mathis

[57] ABSTRACT

A refrigerator includes a housing and a door hinged to the housing. The hinge carries a door opening/closing apparatus in the form of a follower slide member carried by the door and arranged to slide upwardly along a camming slide member during opening of the door, and to slide downwardly along the camming slide member during closing of the door to assist in such closing. The follower slide member is able to rotate slightly before making contact with the camming slide member upon initial opening movement of the door so that the opening/closing apparatus does not increase the force needed to initially open the door.

6 Claims, 5 Drawing Sheets

REFRIGERATOR DOOR OPENING/CLOSING APPARATUS

BACKGROUND OF THE INVENTION

This invention relates to a refrigerator door opening/closing apparatus which can both open and close a door without effort and can automatically close the refrigerator door by the user's light pushing movement.

As shown in FIGS. 4A and 4B, a conventional refrigerator door opening/closing apparatus comprises a hinge member 3 fixed to the side of the refrigerator for rotatably connecting a refrigerator door 1 to a refrigerator cabinet 2, a stopper 4*a* fixed to the cabinet 2 and extending forward toward the door 1, and an U-shaped member 4*b* for flexibly receiving and releasing the stopper 4*a*.

By using such a flexible combination structure of the stopper 4*a* and the U-shaped member 4*b*, the stopper 4*a* formed at the cabinet 2 is tightly inserted into the U-shaped member 4*b* when the door 1 is closed, and removed from the U-shaped member 4*b* when the door 1 is opened.

Accordingly, the user must not only apply a force greater than the engaging force between the stopper 4*a* and the U-shaped member 4*b* to open the door 1, but also must push the door 1 to the end until the stopper 4*a* is surely inserted into the U-shaped member 4*b* to completely close the door 1.

Therefore, the conventional refrigerator door opening/closing apparatus has disadvantages in that operation of opening and closing the door 1 is carried out with great effort.

Another conventional door opening/closing apparatus for solving the above problem is disclosed by Japanese Utility Model Laid Open No. 60-12179.

That door opening/closing apparatus, as shown in FIGS. 5A–5B and 6A–6C comprises a hinge member 3 fixed to the lower side of a refrigerator cabinet 2 for rotatably supporting a door 1, an upper member 5 having a slanted surface 5*a* at its bottom and the top of which is fixed to the door 1, and a lower member 6 having a slanted surface 6*a* corresponding to the slanted surface 5*a* of the upper member 5 at its top and the bottom of which is fixed to the hinge member 3. A hinge shaft 7 passes through the hollow centers of the upper and lower members 5, 6 for rotatably connecting the door 1 to the hinge member 3.

In such a conventional door opening/closing apparatus, when the door 1 is rotated with respect to the hinge shaft 7 to be open, the upper member 5 fixed to the door 1 is slid upward along the slanted surface 6*a* of the lower member 6, so that the door 1 is opened while moving slightly in an upward direction as shown in FIG. 5B.

If the user then lightly pushes the door 1 in reverse to close the door 1, the slanted surface 5*a* of the upper member 5 is slid downward along the slanted surface 6*a* of the lower member 6, so that the door 1 is automatically closed.

However, the door opening/closing apparatus can cause inconveniences in the operation of a refrigerator because when the door 1 is initially opened, relatively greater initial force must be applied to the door 1 in order that the upper member 5 is slid upward along the slanted surface 6*a* of the lower member 6.

Further, the pressure differential between the outside and inside of a refrigerator, due to a negative pressure on the inside of the refrigerator and the magnetic force by a magnet attached to the inner side of the door 1, adds additionally to the above initial force, requiring much greater initial force for opening the door 1.

Accordingly, because of the initial force, the conventional refrigerator door opening/closing apparatus is unsuitable for a large-sized refrigerator.

The object of this invention is to solve the above problems by providing a refrigerator door opening/closing apparatus which can both open and close a door effortlessly and can automatically close the refrigerator door by the user's light pushing movement.

SUMMARY OF THE INVENTION

A refrigerator door opening/closing apparatus according to this invention comprises: a first slide member fixed to a refrigerator door and having a cutting portion at its bottom, the cutting portion having a slanted surface, a horizontal surface and a vertical surface; a hinge member fixed to a refrigerator cabinet; a second slide member fixed to the hinge member having a projection at its top, the projection having a slanted surface, a horizontal surface and a vertical surface corresponding to respective surfaces of the cutting portion; and a hinge shaft fixed to the refrigerator door through the hinge member and the hollow center of the first and second slide members to function as the rotation axis of the door.

When the refrigerator door is opened, the first slide member is horizontally slid along the horizontal surface of the second slide member, to the length of the horizontal surface of the first slide member. After that, the slanted surface of the first slide member contacting the slanted surface of the second slide member, the first slide member is slid upward along the slanted surface of the second slide member, so that the door is completely opened.

When the door is closed again, the first slide member is slid along the horizontal and slanted surfaces of the second slide member, in the reverse order of the opening movement, so that the door is automatically closed.

As another embodiment of the refrigerator door opening/closing apparatus according to this invention, a third slide member may be disposed between the first slide member fixed to the door and the second slide member fixed to the hinge member, thereby obtaining the same operation as the aforementioned embodiment. This embodiment will be described in detail in the following 'Description of the Preferred Embodiments' utilizing the attached drawings.

BRIEF DESCRIPTION OF THE DRAWINGS

In the accompanying drawings:

FIGS. 3A through 3D are side views showing the position relationship of each slide member of the first embodiment during door opening movements, in which FIG. 3A illustrates the slide members when the door is in the closed state, FIGS. 3B and 3C illustrate the slide members when the door is opening, and FIG. 3D illustrates the slide members when the door is in the fully opened state;

FIGS. 4A and 4B show one conventional refrigerator door opening/closing apparatus, in which FIG. 4A illustrates the apparatus when a refrigerator door is in the closed state and FIG. 4B illustrates the apparatus when the door is slightly opened;

FIGS. 5A and 5B show another conventional refrigerator door opening/closing apparatus, in which FIG. 5A is a side view when the door is in the closed state and FIG. 5B is a view showing the position relationship of upper and lower members when the door is in the opened state; and FIGS. 6A through 6C are views showing in detail the parts shown in FIG. 5, in which FIG. 6A is a perspective view of an upper member, FIG. 6B is a perspective view of a lower member, and FIG. 6C is a view showing that a hinge shaft is loosely inserted into the hollow centers of upper and lower members.

DESCRIPTION OF THE PREFERRED EMBODIMENTS

Figure 1:
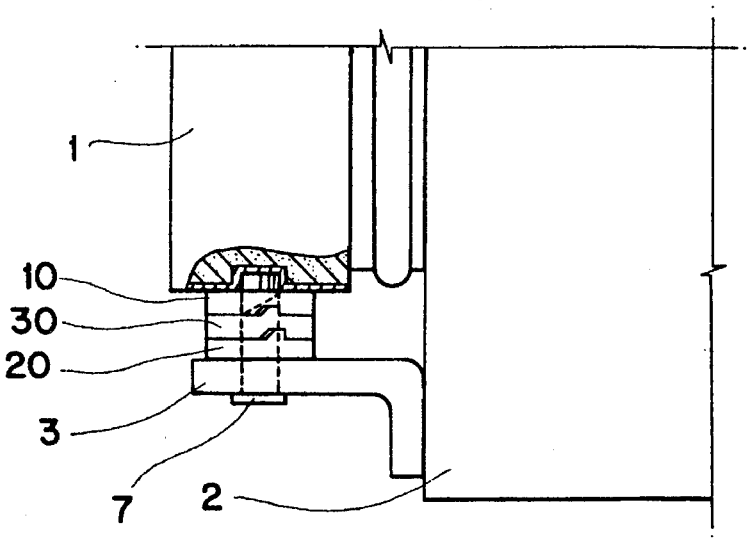
FIG. 1 is a side view of a first embodiment of a refrigerator door opening/closing apparatus according to this invention.
Figure 2:
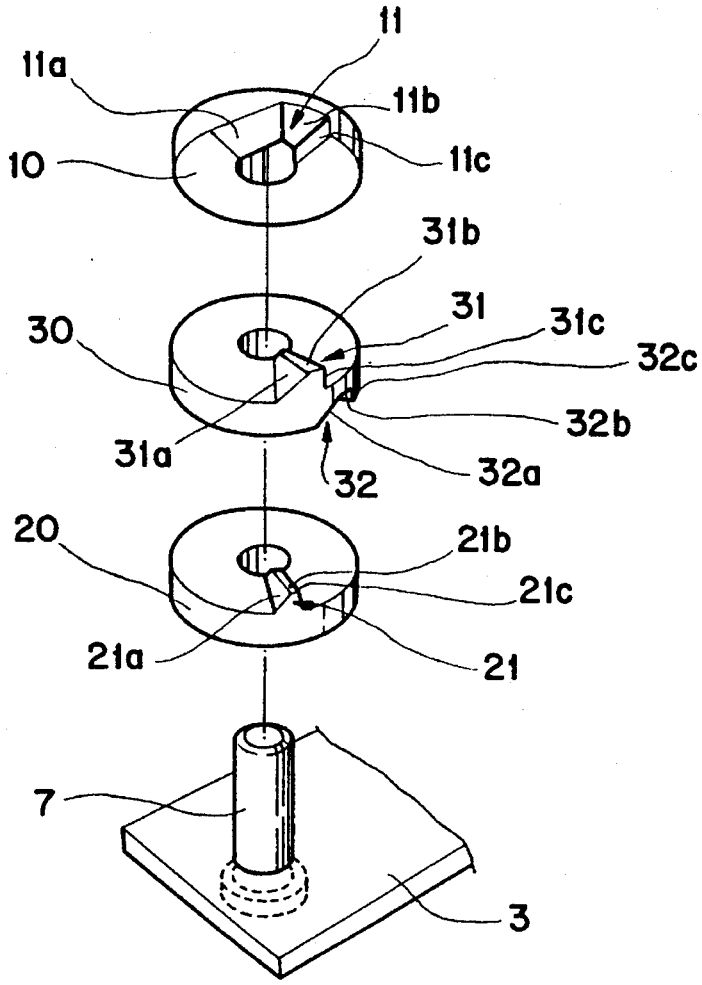
FIG. 2 is an exploded perspective view of the first embodiment of this invention.

FIGS. 1 and 2 are a side view and an exploded perspective view of the refrigerator door opening/closing apparatus according to this invention, respectively.

As shown in the illustrations, the door opening/closing apparatus of this invention comprises a first slide member or follower slide member 10 fixed to a refrigerator door 1, a hinge member 3 fixed to a refrigerator cabinet 2, a second slide member or a lower camming slide member 20 fixed to the hinge member 3, a third slide member or an upper camming slide member 30 rotatably disposed between the first slide member 10 and the second slide member 20, and a hinge shaft 7 passing through the hollow centers of the first to third slide members 10, 20, 30 for rotatably connecting the door 1 with the hinge member 3.

As shown in FIG. 2, a recess 11 is formed in the bottom surface of the first slide member 10, which comprises a follower surface 11*a*, a horizontal surface 11*b* extending to a fixed length from the top of the slanted surface 11*a*, and a vertical surface 11*c* extending vertically from the end of the horizontal surface 11*b*.

A projection 21 is formed on the top surface of the second slide member 20, which comprises a slanted surface 21*a*, a horizontal surface 21*b* extending horizontally to a fixed length from the top of the slanted surface 21*a*, and a vertical surface 21*c* extending vertically from the end of the horizontal surface 21*b*.

A projection 31 corresponding to the recess 11 of the first slide member 10 is formed on the top surface of the third slide member 30, and a recess 32 corresponding to the projection 21 of the second slide member 20 is formed in the bottom surface of the third slide member 30.

The projection 31 of the third slide member 30, like the recess 11 of the first slide member 10 and the projection 21 of the second slide member 20, comprises a slanted surface 31*a*, a horizontal surface 31*b* extending horizontally to a fixed length from the top of the slanted surface 31*a*, and a vertical surface 31*c* extending vertically from the end of the horizontal surface 31*b*.

In the same manner, the recess 32 of the third slide member 30 comprises a slanted camming surface 32*a*, a horizontal surface 32*b* extending horizontally to a fixed length from the top of the slanted surface 32*a*, and a vertical surface 32*c* extending vertically from the end of the horizontal surface 32*b*.

It is desired that the length of the horizontal surface 11*b* of the recess 11 of the first slide member 10 be made longer than the horizontal surface 31*b* of the projection 31 of the third slide member 30.

Figure 3A:
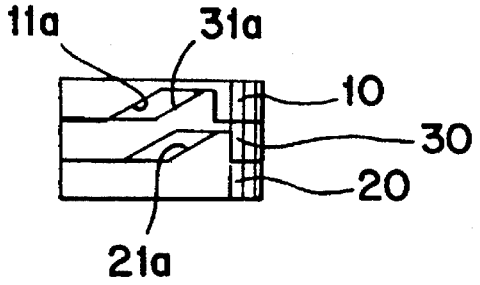

In the closed state of the door 1, the horizontal surface 11*b* and the vertical surface 11*c* of the recess 11, formed at the bottom surface of the first slide member 10, contact the horizontal surface 31*b* and the vertical surface 31*c* of the projection 31, respectively formed at the top surface of the third slide member 30, as shown in FIG. 3A.

In the same manner, the horizontal surface 21*b* and the vertical surface 21*c* of the recess 21, formed at the top surface of the second slide member 20, contact the horizontal surface 32*b* and the vertical surface 32*c*, respectively of the projection 32 formed at the bottom surface of the third slide member 30.

The operation and effect of the door opening/closing apparatus, constituted as above, will be now described in detail.

When the door 1 is in the closed state, the slide members 10, 20, 30, which are held between the door 1 and the hinge member 3 by the hinge shaft 7, are engaged in the relationship shown in FIG. 3A, as described above.

Figure 3B:
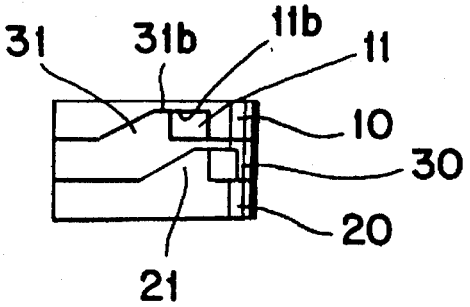

If the door 1 is pulled, as shown in FIG. 3B, the horizontal surface 11*b* of the recess 11, of the first slide member 10, is slid horizontally along the horizontal surface 31*b* of the projection 31 of the third slide member 30, so that the door 1 which had been attracted toward the cabinet 2 by a magnet (not shown) is opened slightly by pivoting about the hinge shaft 7.

Figure 3C:
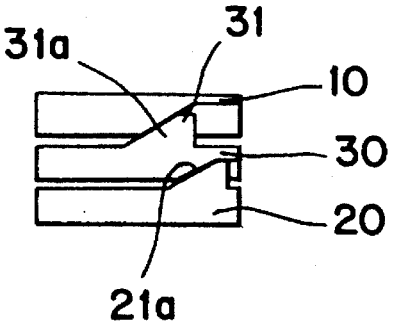

If the door continues to swing open, as shown in FIG. 3C, the slanted surface 11*a* of the first slide member 10 is slid along the slanted surface 31*a* of the third slide member 30, so that the first slide member 10 is moved upward on the third slide member 30. At the same time, the third slide member tends to be rotated by the contact with the first slide member 10, causing the recess 32 formed in the bottom surface of the third slide member 30 to be upward along the slanted surface 21*a* of the projection 21 formed on the top surface of the second slide member 20, after the first slide member 10 is rotated so that the vertical surface 11*c* of the recess 11 contacts the vertical surface 31*c* of the projection 31.

Figure 3D:
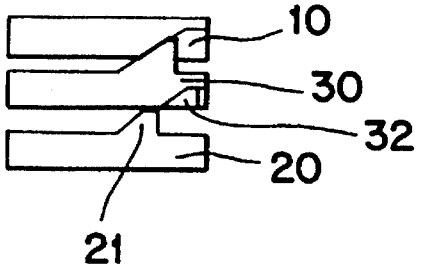

If the first, second and third slide members 10, 20, 30 are positioned as shown in FIG. 3D by the continuous movement of the door 1, the door 1 is completely opened.

As understood from the above description, because the door 1 is initially separated from the cabinet 2 by means of only horizontal movement of the slide members (FIG. 3*b*), little initial force for opening the door 1 is required. Note that before the slide members 10, 30 begin to move upwardly, the door will have already attained some momentum.

If the user thereafter lightly pushes the door 1 in order to close the door, the first, second and third slide members 10, 20, 30 will move in the reverse order of the aforementioned opening movement by the weight of the door 1, so that the door 1 is automatically closed.

That is, as shown in FIG. 3C. Continued swinging of the door produced further rotation of the third slide member 30 until the recess 32 thereof completely disengages from the projection 21 of the second slide member 20, as shown in FIG. 3D. The third slide member 30 is slid downward along the slanted surface 21*a* and the horizontal surface 21*b* of the projection 21 formed at the second slide member 20 and positioned as shown in FIG. 3C, and the first slide member 10 is also moved downward along the slanted surface 31*a* and the horizontal surface 31*b* of the projection 31 formed at the top surface of the third slide member 30, so that once the door 1 has been closed completely, the first, second and third slide members 10, 20, 30 are positioned as shown in FIG. 3A.

The door opening/closing apparatus having only three slide members 10, 20, 30 is exemplified in the aforementioned embodiment.

However, the object of this invention will be accomplished if it is provided only two or more than three slide members.

Figure 3E:
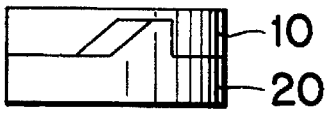
FIG. 3E is a side view of a second embodiment of the invention when the door is closed.
Figure 3F:
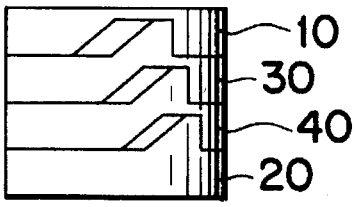
FIG. 3F is a side view of a third embodiment of the invention when the door is closed.
Figure 4A:
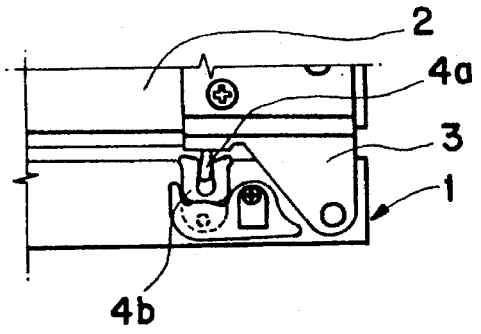
FIG. 4A (PRIOR ART)
Figure 4B:
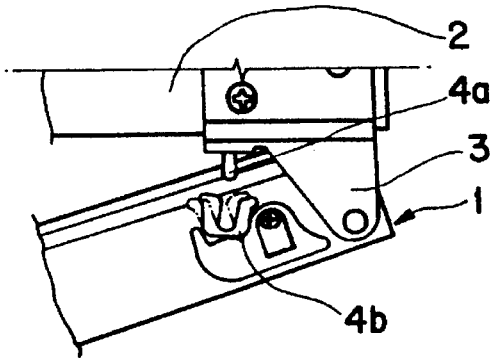
FIG. 4B (PRIOR ART)
Figure 5A:
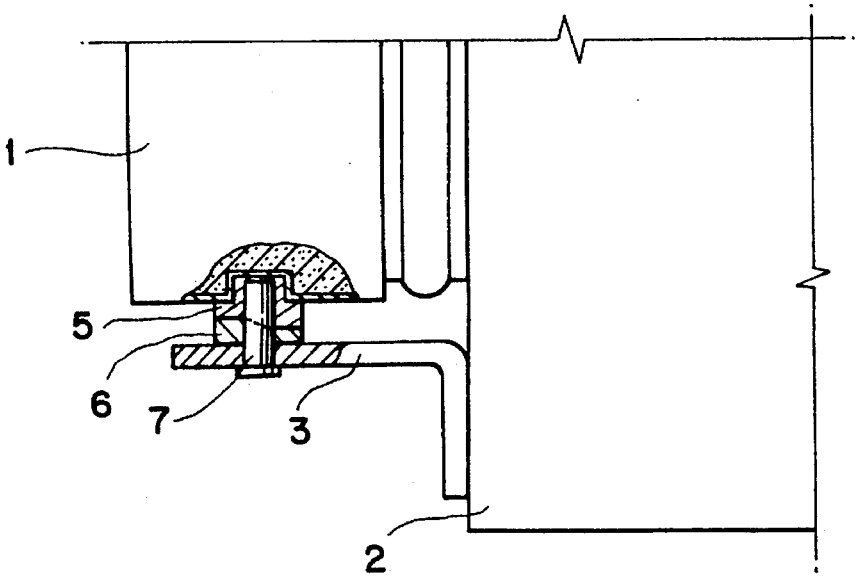
FIG. 5A (PRIOR ART)
Figure 5B:
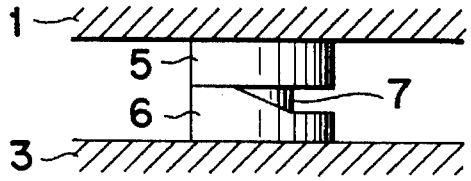
FIG. 5B (PRIOR ART)
Figure 6A:
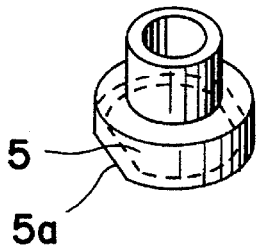
FIG. 6A (PRIOR ART)
Figure 6B:
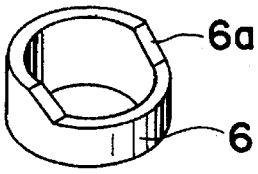
FIG. 6B (PRIOR ART)
Figure 6C:
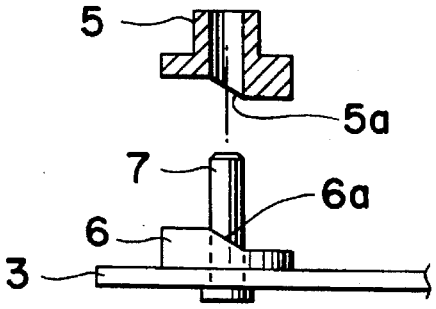
FIG. 6C (PRIOR ART)

That is, this invention not only may be constituted with two slide members by removing the third slide member 30 disposed between the first slide member 10 and the second slide member 20 as shown in FIG. 3E, but also may be constituted with four slide members by disposing an immediate camming slide member 40 above the second slide member 20, as shown in FIG. 3F. However, further description for these cases will be omitted because the operation is the same as that of the earlier disclosed embodiment.

Though the preferred embodiment of this invention has been described in detail referring to the accompanying drawings, various modifications within the scope of this invention are apparent to those skilled in the art.

For example, though this embodiment described only the case that the slanted surfaces of the first, second and third slide members 10, 20, 30 are inclined at the same slant angle, the object of this invention can be also accomplished using mutually different slant angles for the slide members.

As you can read from the above explanation, this invention has advantages in that the refrigerator door is opened and closed very easily by a refrigerator door opening/closing apparatus according to this invention because a refrigerator door can be opened without effort and can be automatically closed by the action of the plurality of the slide members disposed between the door and the hinge member.

This invention is suitable for a large-sized refrigerator which requires greater initial force for opening a door due to the pressure differential between the outside and inside of a refrigerator and the magnetic force of a magnet attached to the inner side of the door, because when the door is initially pulled, the door is moved only horizontally by the action of the slide members.

What is claimed is:

1. A refrigerator, comprising:

a refrigerator housing forming a refrigerating compartment;

a refrigerator door hingedly mounted to said housing for rotation about a vertical axis, to open and close said compartment; and a door opening/closing apparatus, including:

a follower slide member arranged coaxial with said axis and mounted for rotation with said door, and a camming slide member arranged coaxial with said axis and disposed beneath said follower slide member such that said follower slide member is rotatable relative to said camming slide member;

said camming slide member including a slanted camming surface, and said follower slide member including a slanted follower surface arranged to slide upwardly along said slanted camming surface during opening of said door such that said door is slightly raised, and to slide downwardly along said slanted camming surface during closing of said door to assist such closing;

said slanted follower surface being spaced horizontally from said slanted camming surface when said door is in a closed state to enable said door to be partially opened before said slanted follower surface contacts said slanted camming surface.

2. The refrigerator according to claim 1, wherein said camming slide member is mounted to be stationary.

3. The refrigerator according to claim 1, wherein said camming slide member constitutes an upper camming slide member, said door opening/closing apparatus further including a lower camming slide member arranged coaxial with said axis and disposed beneath said upper camming slide member, said lower camming slide member being mounted to be stationary, said upper camming slide member being rotatable relative to said lower camming slide member when said upper camming slide member is contacted by and rotated by said follower slide member, said upper and lower camming slide members including respective slanted surfaces which engage one another during opening of said door whereby said upper camming slide member is slightly raised.

4. The refrigerator according to claim 3, wherein said slanted follower surface and said slanted camming surface of said upper camming slide member are slanted at an angle which is different from an angle at which said engageable slanted surfaces of said upper and lower camming slide members are slanted.

5. The refrigerator according to claim 1, wherein said camming slide member constitutes an upper camming slide member, said door opening/closing apparatus further including a lower camming slide member and an intermediate camming slide member each arranged coaxial with said axis, said intermediate camming slide member disposed vertically between said upper and lower camming slide members, said lower camming slide member being mounted to be stationary, said upper and intermediate camming slide members being rotatable relative to said lower camming slide member and relative to one another, said intermediate camming slide member being driven by said upper camming slide member which is driven by said follower slide member, said upper and intermediate camming slide members including mutually engageable slanted surfaces, and said intermediate and lower camming slide members including mutually engageable slanted surfaces, whereby said upper and intermediate camming slide members are raised relative to said lower camming slide member and relative to one another during opening of said door.

6. The refrigerator according to claim 1, wherein said follower slide member includes a downwardly open recess defined by said slanted follower surface, a first vertical surface, and a first horizontal surface interconnecting said slanted follower surface and said first vertical surface, said camming slide member including a projection disposed in said recess, said projection defined by said slanted camming surface, a second vertical surface and a second horizontal surface interconnecting said second vertical surface and said second slanted camming surface, said first horizontal surface being longer than said second horizontal surface.

* * * * *